US005558284A

United States Patent [19]

Baumung et al.

[11] Patent Number: 5,558,284

[45] Date of Patent: Sep. 24, 1996

[54] CRUSHING APPARATUS

[75] Inventors: Ralph F. Baumung; Gary L. Everett, both of Cambridge, Canada

[73] Assignee: R. Baumung Industries Limited, Cambridge, Canada

[21] Appl. No.: 331,560

[22] PCT Filed: Feb. 23, 1994

[86] PCT No.: PCT/CA94/00090

§ 371 Date: Oct. 20, 1994

§ 102(e) Date: Oct. 20, 1994

[87] PCT Pub. No.: WO94/19106

PCT Pub. Date: Sep. 1, 1994

[30] Foreign Application Priority Data

Feb. 24, 1993 [GB] United Kingdom ..... 9303749

[51] Int. Cl.[6] ..... B02C 13/00; B02C 21/02

[52] U.S. Cl. ..... 241/101.741; 241/187; 241/189.1; 241/289

[58] Field of Search ..... 241/187, 189.1, 241/190, 273.3, 287, 289, 101.7, 101.741

[56] References Cited

U.S. PATENT DOCUMENTS

| | | | |
|---|---|---|---|
| 1,620,659 | 3/1927 | Hodgkinson . | |
| 2,375,370 | 5/1945 | Krider | 241/289 |
| 2,665,632 | 1/1954 | Kawa . | |
| 2,675,970 | 4/1954 | Edwards . | |
| 2,853,240 | 9/1958 | Mahoney, Jr. | 241/101.7 X |
| 2,993,657 | 7/1961 | Meyer | 241/187 |
| 3,252,664 | 5/1966 | Rougemont | 241/101.7 |
| 3,504,621 | 4/1970 | Qualheim | 100/96 |
| 3,952,647 | 4/1976 | Holbrook et al. | 11/98 R |
| 4,119,024 | 10/1978 | White | 100/35 |
| 4,195,562 | 4/1980 | Mickler | 100/39 |
| 4,275,650 | 6/1981 | Telling | 100/45 |
| 4,358,955 | 11/1982 | Ballo et al. | 100/98 R |
| 4,506,837 | 3/1985 | Schrodl | 241/97 |
| 4,516,489 | 5/1985 | Ballo | 100/98 R |
| 4,949,633 | 8/1990 | Johnson et al. | 100/65 |
| 4,987,829 | 1/1991 | Hudson | 100/45 |
| 5,125,585 | 6/1992 | Williams | 241/189.2 |
| 5,152,387 | 10/1992 | Hammond | 194/208 |
| 5,253,971 | 10/1993 | Weinlader | 241/101.741 X |
| 5,490,636 | 2/1996 | Schrödl | 241/189.1 |
| 5,503,339 | 4/1996 | Doppstadt | 241/166 |

FOREIGN PATENT DOCUMENTS

| | | |
|---|---|---|
| 2374084 | 7/1978 | France . |
| 2671755 | 7/1992 | France . |
| 416287 | 9/1934 | United Kingdom . |
| 1468662 | 3/1970 | United Kingdom . |
| 2055790 | 3/1981 | United Kingdom . |

*Primary Examiner*—John M. Husar
*Attorney, Agent, or Firm*—Anthony Asquith & Co.

[57] ABSTRACT

Householders separate metal cans, plastic bottles, containers and similar items from other garbage. The crushing apparatus is carried on the recycling truck, and the driver tosses these items into the apparatus for crushing. The apparatus has a rotating crusher rotor (12) which forms a pinch-throat against a concavely-curved crusher plate (27). A crammer (40) is driven into reciprocation to cram the larger items into the mouth of the pinch-throat. A rubber pad (49) on the crush plate creates friction to assist in the grabbing the item into the mouth.

24 Claims, 6 Drawing Sheets

CRUSHING APPARATUS

BACKGROUND OF THE INVENTION

This invention relates to crushing apparatus, of the type that is suitable for crushing metal cans, plastic bottles, and the like.

It is becoming increasingly common that householders are prepared to separate out certain items of garbage which are suitable for recycling. Each householder has a special receptacle, separate from the other garbage, in which the recyclable items are placed. It is part of the recycling truck operative's task to place the recyclable items in a separate compartment on the recycling truck.

DESCRIPTION OF THE PRIOR ART IN RELATION TO THE INVENTION

One of the problems with such items as cans, bottles, and containers is that an un-crushed heap of the items occupies a large volume of space without much weight. It is desirable that the items be crushed prior to being placed in the truck. A recycling truck has capacity enough to carry the weight of the garbage: the limitation generally is one of volume. The compaction of garbage of course is a well-known measure, and most trucks include compacting means whereby Ordinary garbage is placed straight into the compactor. Conventionally, each individual item of garbage is carried at its un-compacted volume only for a short distance.

The same principle of reducing the volume of the item as soon as the item is placed on the truck applies equally to the recyclable items. However, the crushing process required is somewhat different from the process for ordinary garbage. In ordinary compaction, the individual items are fed into a large hopper, and the items are crushed together by a heavy ram. This has the effect of locking many of the items together. As many as fifty percent of the items can be inseparable after compaction in a ram-type compactor.

One of the key aspects that goes towards making recycling an economical proposition is that each individual recyclable item must be readily separable from all the other recyclable items. Therefore, it is required of the manner in which the items are crushed that the manner of crushing does not cause the items to become locked together in a way that would make it subsequently difficult to separate the items. By contrast, where the garbage is simply to be placed in a landfill, it does not matter that items cannot be separated.

It is not too much to say that whether recycling of household containers can proceed as an economical industrial activity depends on whether the items can be crushed without being compacted, ie without being locked together, on the recycling truck.

The invention is aimed at providing an apparatus which is effective to crush metal cans and plastic bottles without compacting them together, and which is small enough to fit conveniently on a recycling truck, and which can be powered by power sources available on the recycling truck.

Another factor which affects the acceptability of recycling as an industrial process is whether the items are individually safe and easy to handle. If the crushing apparatus results in the metal items being torn, the cost of taking precautions against the resulting protruding sharp edges can be too much. The invention is aimed at providing an apparatus which does not tear the metal items as it crushes them.

The householder collects the plastic and metal containers for recycling into the special container (termed the "blue box" in many jurisdictions) provided for recyclable items. Upon collection, the recycling truck operative tosses the contents of the blue box into a hopper of the crushing apparatus. The invention is aimed at providing an apparatus which can receive and process all the items tossed in from the blue box, including the occasional un-crushable item that has got into the box by mistake.

As mentioned, it is a fact that the ram-type of compactor, if such were used on recyclable items, would tend to make the individual recyclable items lock together. The invention is based on a rotary crusher mechanism, which has been found to be much less prone than the ram-type to causing the items to lock together. The following is proposed as an explanation for this difference.

In a ram-type compactor, it may be observed that the items are not crushed evenly. When a heap of items is placed in the crushing chamber, and crushed, the metal cans naturally tend to collapse at first in the centre, while the more rigid ends of the can, supported by the end walls and flanges of the can, retain their shape for much longer. If, therefore, can A lies with one of its ends against the centre of can B, the end wall of can A drives easily into the soft centre of can B, which collapses the centre of can B. As the centre of can B collapses, the end walls of can B are naturally drawn together, and in fact the converging end walls of can B are drawn together over the end wall of can A. The end walls of can B therefore curl over onto the end wall of can A. Once this curling over has started, there is nothing in the action of a ram-type compactor to break cans A and B free from each other, and in fact the locking together, once started, becomes more consolidated as crushing is completed.

This locking together of the items happens much less frequently in the apparatus as described herein. When a rotor, as opposed to a ram, is performing the crushing, the items are in constant motion upon being drawn into the nip or pinch of the crushing apparatus, and therefore the items tend to shake or pull themselves apart and align themselves individually within the apparatus. Also, in the described apparatus the rotor is equipped with blades or splines, which concentrates the crushing action at the tips thereof, and allows the portions of the item not directly under the tips to buckle and fold into the spaces between the splines. Therefore, the buckling and folding portions tend not to buckle and fold into adjacent items, and thus items do not lock together.

Metal and plastic containers are often placed in the blue box with a screw cap or other stopper in place. Pressure can therefore build up in the container when crushing is attempted, which can make crushing difficult. It is not that the pressure required to crush a sealed container is too high for the apparatus, but rather that it is more difficult for the crushing rotor to dent the walls of a sealed container enough to gain a purchase—once the purchase is obtained, the sealed container is crushed as easily as an unsealed container. The crushing rotor preferably is equipped with pointed spikes for the purpose of piercing sealed plastic bottles, and thus relieving pressure build-up inside the container during crushing.

Metal containers also may be present in the blue box with the cap on, and the spikes should be robust enough to pierce not only plastic containers but also metal containers. It may be noted that spikes on the rotor will tend to drive the material inwards, and so the puncturing of the metal does not give rise to a protruding dangerous sharp edge.

DETAILED DESCRIPTION OF PREFERRED EMBODIMENT

By way of further explanation of the invention, an exemplary embodiment of the invention will now be described with reference to the accompanying drawings, in which.

Figure 7:
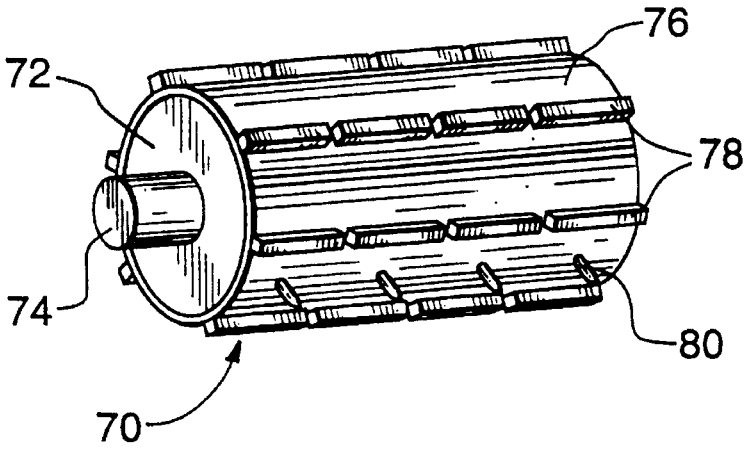
FIG. 7 is a view of a crush-roller of another crusher apparatus.
Figure 7A:
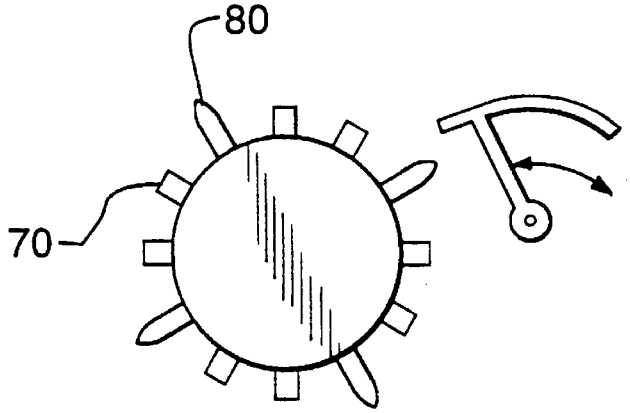
Figure 8:
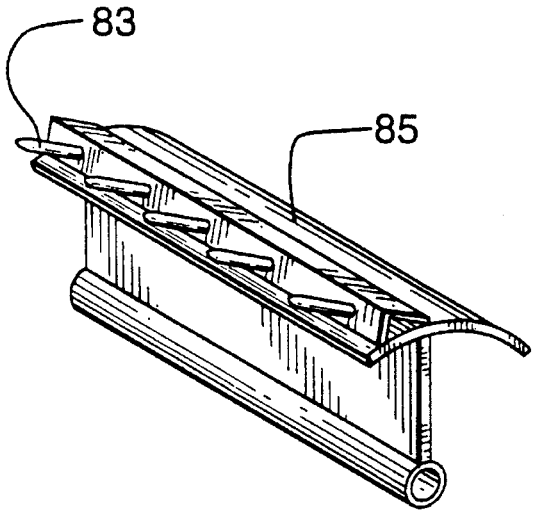
Figure 9:
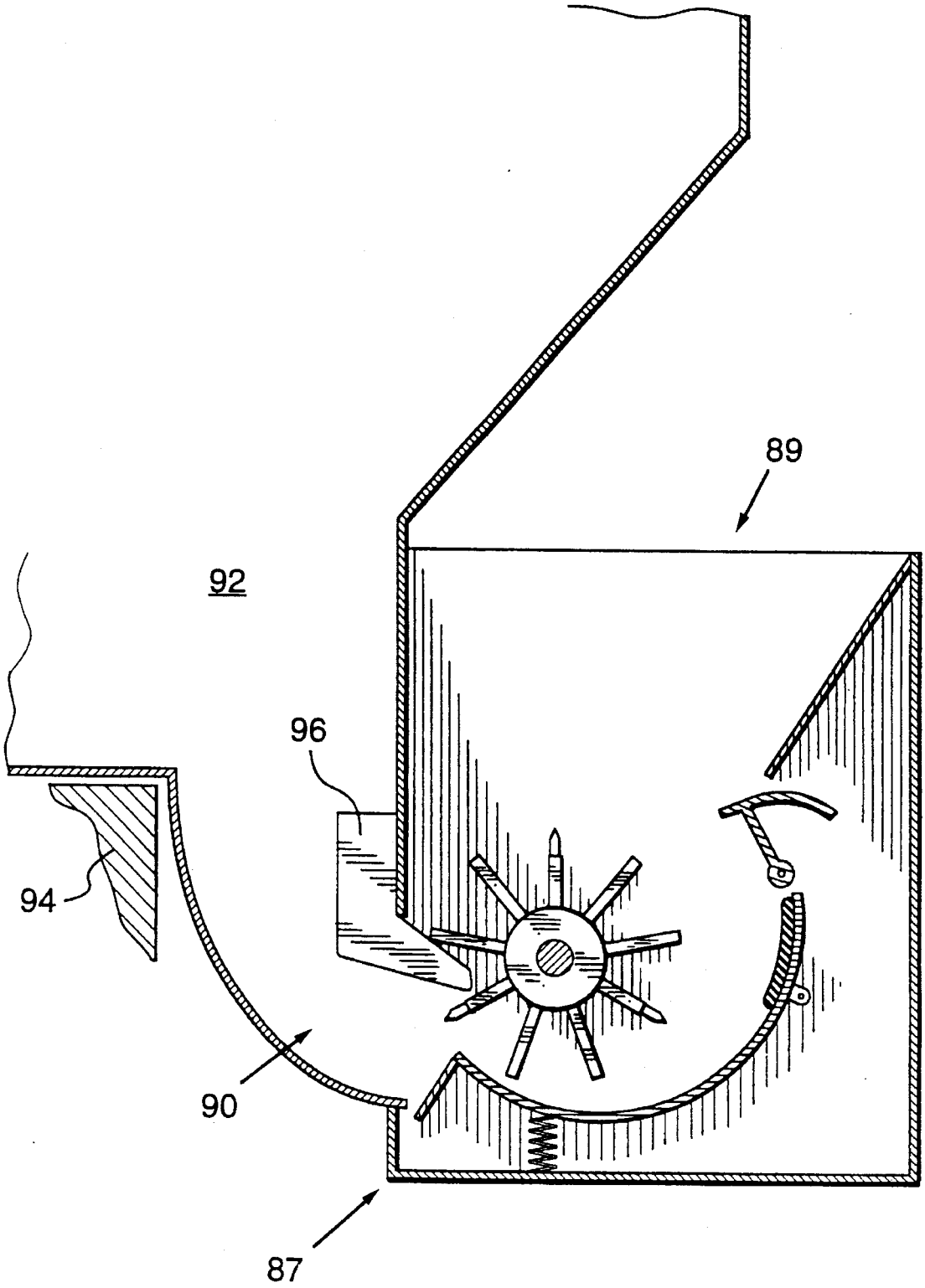

FIG. 7*a* is a diagammatic end elevation of the roller of FIG. 7 in operation;

FIG. 8 is a view of a crammer component of another crusher apparatus;

FIG. 9 is a diagram of a crusher unit mounted in a truck, crushed items of garbage being stored in a receptacle within the truck.

The apparatuses shown in the accompanying drawings and described below are examples which embody the invention. It should be noted that the scope of the invention is defined by the accompanying claims, and not necessarily by specific features of exemplary embodiments.

The apparatus includes a crush rotor 10, which comprises a central cylindrical shaft 12, to which are attached a total of nine blades or splines. Three of these splines 14 are radially short, and carry pointed spikes 16 which protrude radially from the spline 14. The other six splines 18 are rather longer radially, whereby the tips of the spikes 16 are at about the same radius as the ends of the splines 18.

The shaft 12 is mounted in bearings 20 in a fixed frame 21, and is driven for rotation through a reduction chain drive 23, by a motor 25. The motor 25 is a hydraulic motor powered by the hydraulic pressure that is conveniently available on most recycling trucks. On other trucks, and on stationary installations, other power sources may be more appropriate. The rotor 10 is set to rotate at a speed of about 50 rpm.

Figure 1:
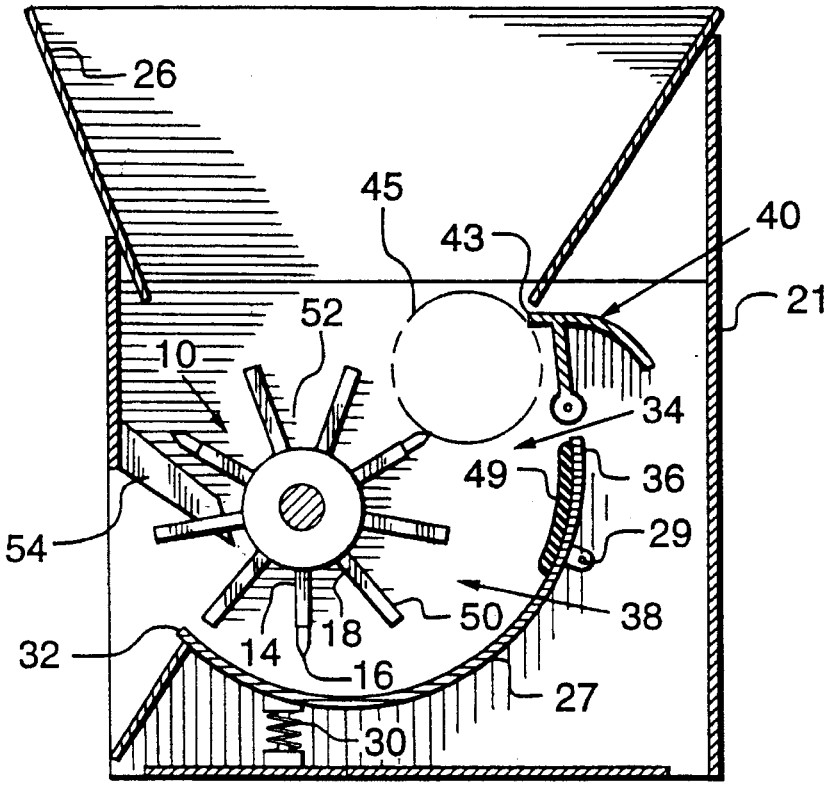
FIG. 1 is a cross-sectional side elevation of a crusher apparatus which embodies the invention, shown with a crammer of the apparatus in a retracted position.

The rotor 10 is set to rotate clockwise in FIG. 1. A hopper 26 receives items to be crushed, and directs the items onto the top of the rotor, which drives the items to the right.

Also mounted in the frame 21 is a crush plate 27. The crush plate 27 is curved, and is mounted with the concavity of its curvature facing the crush rotor 10. The crush plate 27 is mounted for arcuate movement about a pivot 29. Strong springs 30 urge the lower end 32 of the crush plate towards the crush rotor 10. Stops (not shown) prevent the plate 27 from actually touching the rotor.

The crush rotor 10 and crush plate 27 are so arranged with respect to each other as to create an open mouth 34 between the top end 36 of the plate 27 and the rotor. As may be seen from the drawings, the distance of separation between the crush plate and the crush rotor then diminishes, tapering to a minimum distance of separation at the lower end 32 of the plate.

Items entering the open mouth 34 are therefore drawn into a gradually narrowing pinch-throat 38 between the crush rotor 10 and the curved crush plate 27. The spring 30 is strong enough that the plate 27 does not, in normal operation of the apparatus, move away from the rotor 10, except when an item enters the throat 38 that cannot be crushed. Thus the spring 30 serves as a safety relief, to prevent damage to the apparatus.

In fact, it may be arranged that the spring 30 is depressed during normal operation, and that a multiple-rate spring be fitted, whereby different degrees of crushing are imparted at different force levels.

A crammer 40 is mounted in bearings in the frame 21 for arcuate reciprocating motion with respect to the crush rotor 10 and to the open mouth 34. The crammer 40 is driven as an accessory from the drive 23 to the crush rotor. The crammer 40 moves in what can be described as a pecking motion, whereby items present in the open mouth 34, waiting to be crushed, are crammed into the mouth 34 by a beak 43 of the crammer.

Figure 2:
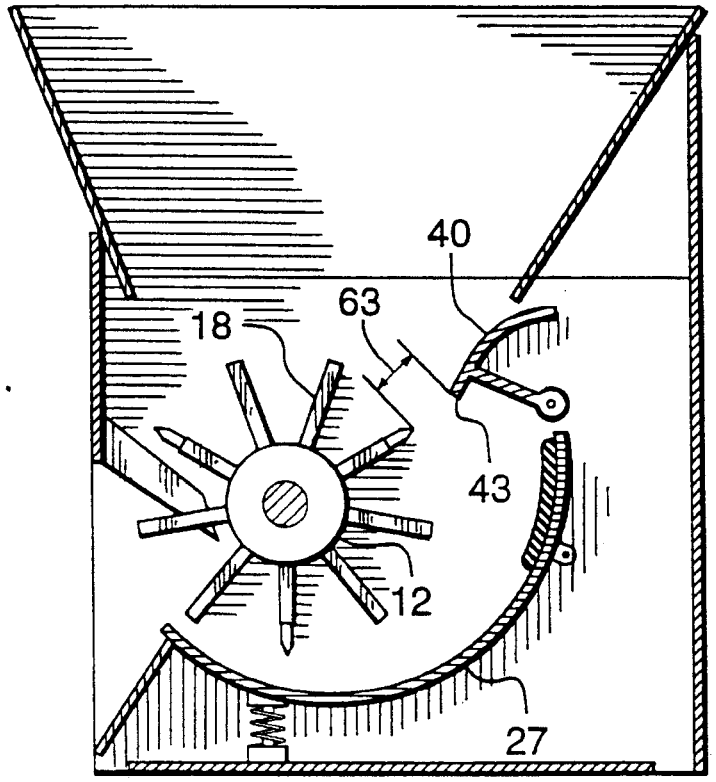
FIG. 2 is the same view as FIG. 1, but with the crammer in an extended position.

The crammer 40 moves from an retracted position as shown in FIG. 1, to an extended position as shown in FIG. 2. When the crammer is open (FIG. 1) the crammer is far enough away from the rotor 10 to permit a cylindrical item 45 of diameter about 18 cm to reside between the rotor 10 and the crammer. In this position, it will be noted that when the beak 43 arcs to the left, and contacts the item 45, the beak makes contact above the axis or centre of the item 45. Thus, when the beak 43 arcs to the left, the item 45 is trapped.

In the particular apparatus as shown, if the item 45 were larger in diameter than about 18 cm, the beak would effectively be pushing upwards against the item, in which case the item probably would never be crammed into the mouth 34. Therefore, the apparatus as described is not suitable for items larger than about 18 cm, ie it is not suitable for items of which the diameter is too large for the item to adopt the position of item 45 in FIG. 1. Once the item 45 reaches the position shown in FIG. 1, although it might bounce and bobble around in the mouth 34 for a few moments, the item will inevitably eventually be crammed into the mouth, and be drawn into the nip or pinch-throat between the rotor and the plate.

Of course, a larger size of apparatus could be built, which would accommodate larger items. However, it is recognised that an apparatus that is limited to containers no larger than 18 cm is perfectly adequate for the general run of household recyclable items, and it is recognised also that an apparatus constructed as described, and of a size to accommodate 18 cm containers, is very well sized for installation on, and operation on, the general run of recycling trucks.

It may be noted that other designs of crushing apparatus which have the capacity to accommodate items of 18 cm diameter, are generally much larger than the apparatus as described herein. It is an aim of the invention to provide an apparatus which accommodates large items for crushing, wherein the apparatus itself is compact enough for installation on a recycling truck.

Figure 3:
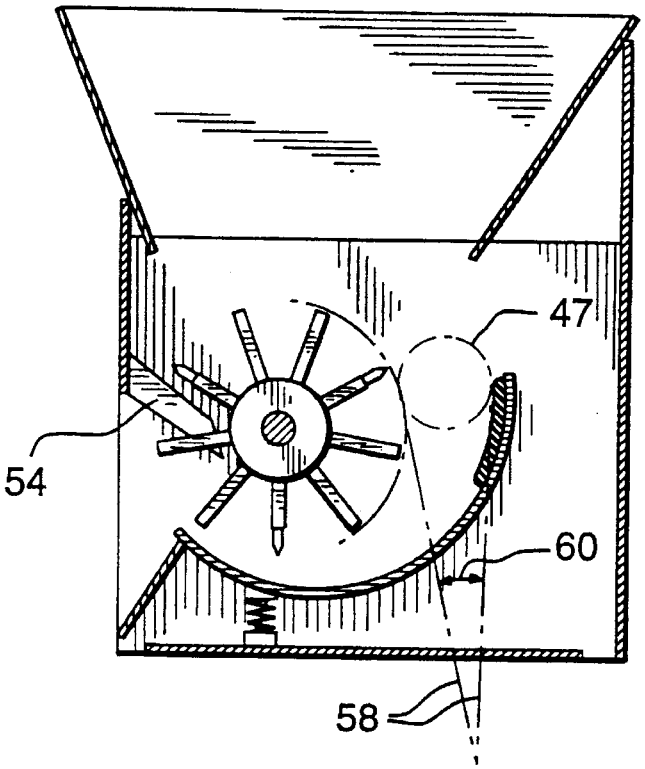
FIG. 3 is the same view as FIG. 1, the crammer being omitted.
Figure 4:
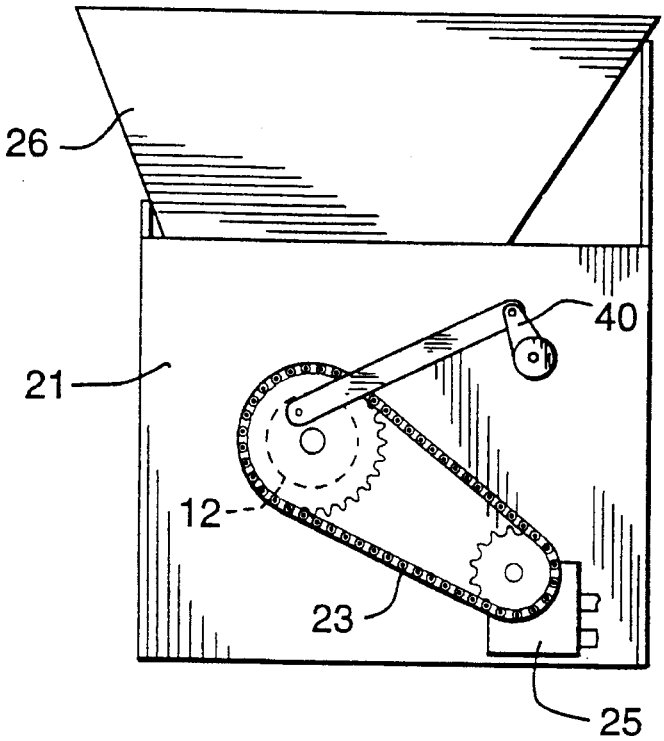
FIG. 4 is a side elevation corresponding to FIG. 1.
Figure 5:
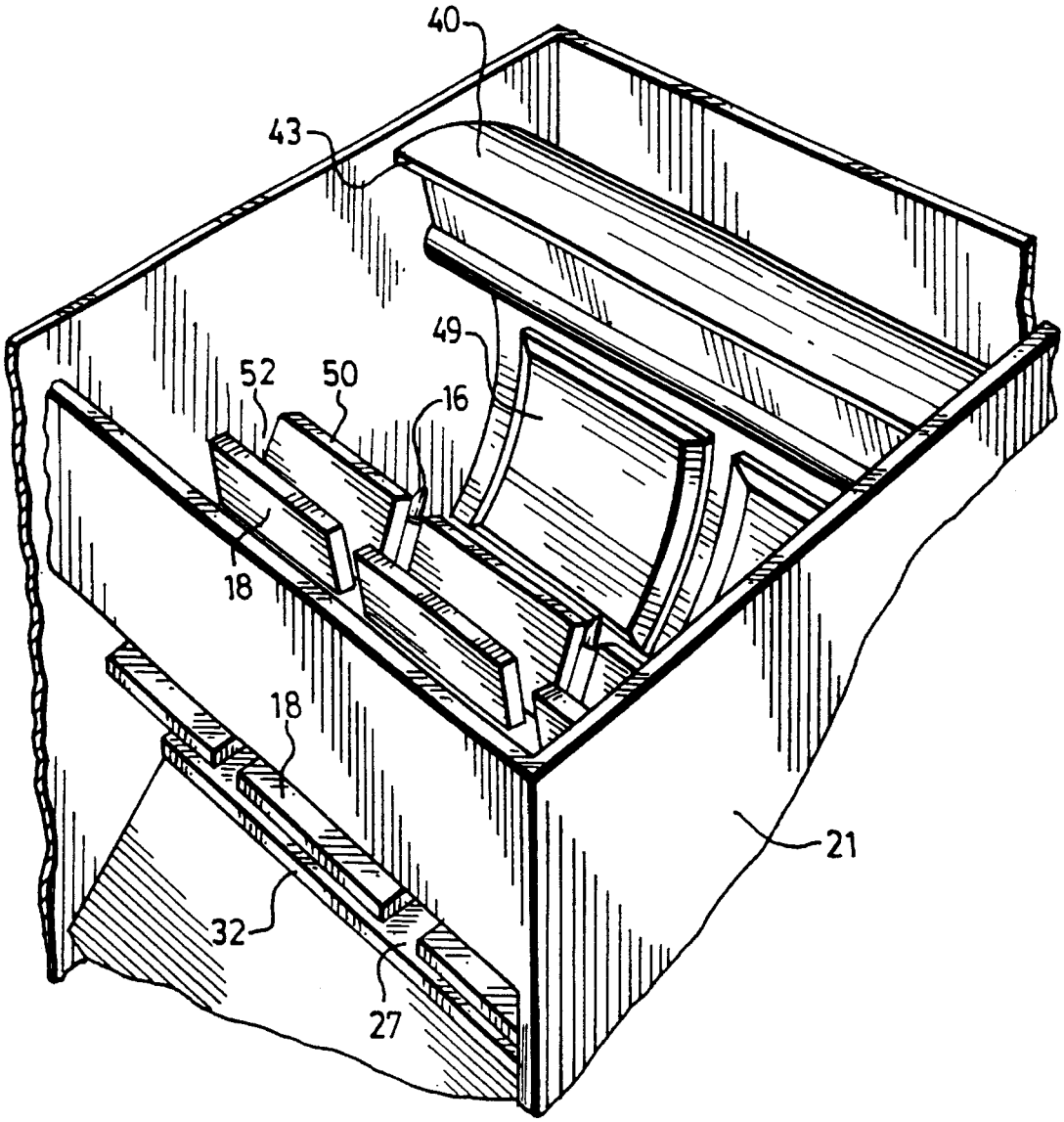
FIG. 5 is a pictorial view of the crusher of FIG. 1, shown with a hopper of the apparatus removed.
Figure 6:
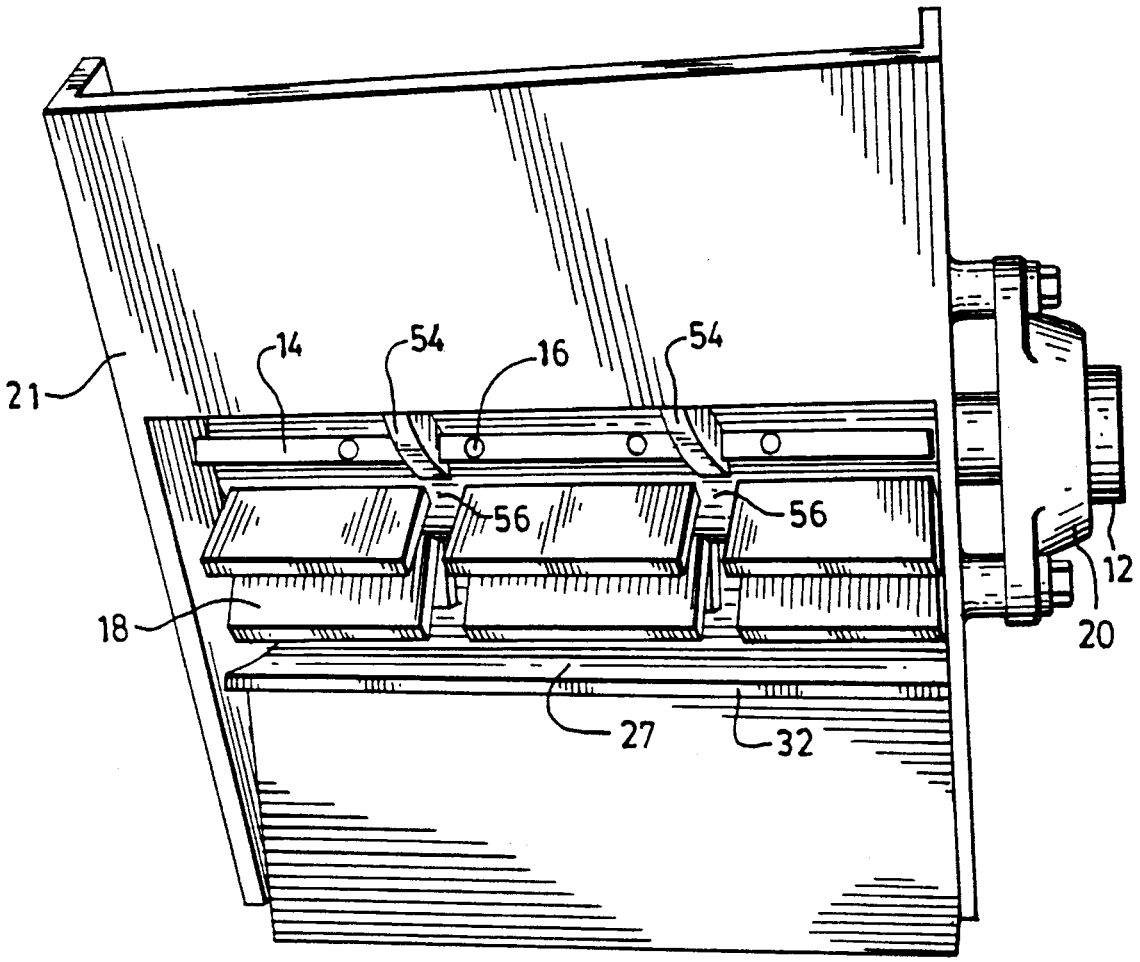
FIG. 6 is another pictorial view of the crusher of FIG. 1.

Without the crammer 40, the diameter of item that would enter the mouth 34 of its own accord would be considerably smaller; in fact, without the crammer, the largest cylindrical item that could be accommodated would be 13 or 14 cm in diameter, as shown at 47 in FIG.3. That is to say, without the crammer 40 items larger than 14 cm in diameter would not enter the mouth 34.

Items smaller than 13 or 14 cm of course will easily enter the mouth, and pass into the pinch-throat of the apparatus, with little trouble. If the item has one dimension greater than 13 or 14 cm—if the item is a plastic bottle of 12 cm diameter and a height of 22 cm, for example—the item will bounce around until it happens to tumble with its 12 cm diameter aligned parallel with the axis of the rotor, which may take a few seconds; and then the item will be drawn into the pinch-throat of the apparatus.

The curved crush plate 27 is furnished near its upper end 36 with a mat of rubber 49. The rubber 49 serves to increase the friction between the crush plate and an item entering the open mouth 34. This friction serves to improve the efficiency with which the items are grabbed at the mouth 34, allowing the item to be forced into the pinch-throat of the apparatus. The rubber mat 49 also serves to deaden some of the noise that can arise from the crushing apparatus.

The splines 14,18 are aligned parallel to the axis of the rotor 10, and are welded firmly to the heavy shaft 12. The splines themselves are of heavy gauge bar, whereby the splines and the shaft are extremely robust, and highly capable of crushing the metal and plastic containers encountered in recyclable household items. The shaft 12 is 12 cm in diameter, and the tips 50 of the long splines 18 form an overall diameter of 24 cm. There are nine splines in total, the splines thus being pitched 40 degrees apart around the shaft 12. The tips 50 of the splines 18 thus lie with an open space between adjacent tips of about 7 cm.

The pointed spikes 16 are screwed into the short splines 14, and the tips of the spikes lie on the same 24 cm diameter. The spikes are robust enough to pierce metal or plastic containers falling into the apparatus, puncturing the item, and preventing air pressure from building up inside the item.

It should be noted that the dimensions of the splines are such that the items are crushed between the tips 50 of the splines and the crush plate 27. During crushing, the items in fact do not, as a rule, penetrate deep enough between the splines to contact the cylindrical shaft 12. It is the tips of the splines that do the crushing, not the shaft 12. The tips of the splines concentrate the crushing action over a small area.

The fact that the items do not touch the shaft 12 is often an advantage. The splines are deep enough that the open spaces 52 between the splines allow each individual item to fold and buckle substantially into the spaces 52 without interfering with neighbouring items. This freedom of each item to distort in its own way helps to keep the items separate.

If the items were crushed with a flat rotor, or with a rotor which, though splined, had splines so short that the items could make substantial contact with the shaft between the splines, then there would be nowhere into which the buckling and folding material could freely buckle and distort. As a result, the items would tend to overlap and become compacted together. By contrast, the radially deep splines in the apparatus as described provide spaces 52 between the splines of sufficient depth to allow the progressively buckling material to distort without interlocking other pieces.

In the apparatus as described, it almost never happens that two items become so interlocked and compacted together that they do not simply fall apart upon emerging from the apparatus. (It should be stated that an exception to this general rule occurs when a large can and a small can happen to fall into the apparatus with the small can wholly inside the large can. In that case, the two cans, upon emerging, often are compacted inextricably.) It does however happen from time to time that an item becomes enwrapped around one of the splines 18, and especially around the spikes 16. The item then tends to remain on the crush rotor 10, being dragged around with the rotor.

To strip such enwrapped items from the rotor, two strippers 54 are provided. These comprise rods, welded to the frame 21, which protrude into gaps 56 in the splines. The strippers reach almost to the surface of the shaft 12. Any item which becomes enwrapped in such a manner that a portion of the item overhangs into the gap 56, will be swept away by the stripper from the spline or spike on which it is enwrapped. As a result, in the apparatus as described it is unusual for any item to remain snagged on the rotor for more than two or three revolutions.

When considering the mechanism or process by which items enter into the mouth 34, it may be noted that a compromise arises between the width of the mouth, and the angle of nip or pinch at the mouth. (This angle of pinch at the mouth 34 of course is on the curve, as will be understood from the drawings. Tangents 58 may be drawn to the overall diameter of the rotor and to the curved plate. These define the angle of pinch 60.) The designer could easily make the mouth 34 larger in width, if he did not care about increasing the angle of pinch: however, the items will only enter and continue through the pinch-throat if the pinch angle 60 is small. For the item not only to enter the mouth, but to be drawn through the mouth and into the pinch-throat 38 of the apparatus, the pinch angle 60 must be small: if the pinch angle 60 is too steep, the item will simply bounce around at the mouth 34, and will not be drawn in. Thus, if the designer wishes to make the apparatus accept larger items, it is not enough for the designer simply to make the mouth 34 larger; he must take care also to keep the pinch angle 60 small. The pinch angle should be no more than about 20 degrees, and preferably should be about 15 degrees.

Without the crammer 40, the only way in which the pinch angle 60 can be kept small, when increasing the width of the mouth, is to increase the diameter of the rotor, and to increase the dimensions of the rest of the components of the apparatus, in proportion. The crammer 40 allows larger items to be accommodated without the need to increase the size of the rest of the components of the apparatus, and in particular without the need to increase the width of the mouth.

It may be noted that the action of the crammer is, to some extent, similar to that of a reciprocating compactor. One of the problems, as mentioned, of the conventional reciprocating compactor is that the items are compacted inseparably together, which is unacceptable. In the crammer, however, the beak 43 of the crammer does not crush the items against the rotor. In fact, the beak of the crammer never gets closer (distance 63, FIG. 1) than about 5 cm, typically, to the tips of the splines on the rotor. As a result, the crammer does not compact the items; the crammer merely performs a preliminary distortion of the larger items, until the item has a dimension short enough to allow the item to enter the mouth of the apparatus.

When the crammer 40 is in its extended position (FIG. 2) the crammer to a large degree blocks access to the mouth 34, and by so doing momentarily breaks the gravity fed stream of material entering the mouth. The resulting metered feeding of the items helps to prevent overfeeding and hence overloading the apparatus.

At the time the crammer is carrying out its preliminary distortion of the item, the item is being bounced and shaken by the action of the moving splines, which again helps to ensure that individual items do not become compacted together.

The rubber mat 49 serves to allow the splines to gain a purchase on the items. If the rubber were not present, there would be little friction at the top end 36 of the crush plate, whereby it would be possible for the item to slide with respect to the surface of the crush plate.

In the lower portion of the crush plate, it is of course required that the item being crushed must slide over the surface of the crush plate, and therefore a low friction is beneficial in the lower portion of the crush plate. But near the top of the crush plate the situation is different: before the item has actually been drawn into the mouth, the item tends not to slide but rather the rolling action from the rotor drives the item into rotation.

Thus in FIG. 1, the rotor 10 is rotating clockwise, which drives the item to rotate anti-clockwise. The item is therefore moving upwards at its point of contact with the crush plate 27. Once its position in the pinch-throat is established, the item then exhibits little tendency to rotate, and slides bodily down the crush plate: before entering the mouth of the pinch-throat, the item does tend to rotate, whereby, at its point of contact with the crush plate, the item is moving upwards relative to the crush plate. Thus, while the item is residing at the entrance to the pinch-throat, but has not yet been grabbed into the pinch throat, the item is not moving bodily at all, but is simply rotating.

As mentioned, insofar as the item is rotating anti-clockwise (in FIG. 3) the right side of the item, ie the side of the item in contact with the crush-plate, is moving upwards. This upwards movement of the item relative to the crush plate can be resisted, it has been found, by the addition of the rubber mat, which increases the coefficient of friction between the item and the crush plate in the critical zone. With the extra friction due to the rubber, the upwards movement of the item relative to the rubber, ie relative to the crush plate, is resisted. The friction resists the rotation of the item. The item is therefore less able to simply rotate in the entrance to the mouth, and is therefore less able to escape being grabbed and drawn into the mouth and into the pinch-throat.

It is the larger items, of course, that have the problem of being reluctant to enter the mouth. The presence of the rubber enables the tips of the splines to gain a purchase on the large diameter items; once the item has been drawn into the mouth, the pinch of the apparatus takes over, and crushing proceeds.

Once the item has passed the mouth, the item is trapped, and now it is preferred that the item should slide with as little friction as possible over the surface of the crush plate; that is why the rubber mat should be present only in the zone near the mouth, and not over the whole surface of the crush plate.

The smaller items pass straight into the mouth 34 of the pinch-throat, without being driven into rotation at the mouth. It is observed that the smaller items that emerge, crushed, from the apparatus have indentations only on one side (ie indentations from the tips of the splines), whereas the larger items have indentations on both sides, and at many different orientations, indicating that the larger items suffered several "snatches" at the mouth before being finally grabbed.

The position of the crush plate pivot 29 is important. If the pivot were too high, ie close to the top end 36 of the crush plate, the arc of the crush plate might cause the crush plate to undergo a self-servo action. In such a case, an excessive crush force would cause the crush plate to move upwards into the rotor, instead of downwards against the spring 30. Given the location of the lower end 32, ie the point at which the items exit from the pinch-throat, of the plate 27, the pivot should be no more than about 100 degrees of arc of the crush plate away from the lower end, in order to avoid any possibility of the self-servo effect.

The apparatus as described is aimed at overcoming a special compromise: that is to say, the apparatus has to be small enough to be accommodated on a recycling truck, and yet the apparatus has to be able to process (nearly) all the items put out for recycling by the householder. The apparatus is intended to be used to crush the kinds and sizes of metal and plastic containers normally found in household garbage. The householder places the cans and plastic bottles in a special container for recycle-able items (the "blue box"). The apparatus as described is mounted on the recycling collection truck, and the aim is that the apparatus will receive all the said containers, and will crush these items prior to the items being fed into the appropriate transportation compartment on the truck. The truck operative must be required to spend as little time as possible in sorting out the items for size or type: preferably the apparatus should accept all sizes.

The largest plastic bottles likely to be found in the blue box of recyclable household garbage are the rectangular 4 litre containers used typically for wind-shield washer fluid or the like. These have overall dimensions around 18×11×20 cm. The largest metal containers likely to be found in the blue box are the rectangular containers used typically for 4 litres of cooking oil, syrup, or the like. These have overall dimensions of around 11×16×26 cm. The largest circular (ie cylindrical) container normally encountered in the blue box is the metal container typically used to contain 4 litres of coffee or the like, which is about 18 cm diam×20 cm long. The metal cans may be either of steel or aluminum.

The apparatus as described is aimed at crushing these sizes of items, and of course smaller sized items, without interlocking the items together, and without tearing metal and producing sharp edges. To accommodate these sizes in an apparatus which itself fits within a small space envelope, the overall diameter of the crush rotor is 20 cm, and the pinch-throat width at the mouth 34 is 10 cm.

FIG. 7 shows a modified form of crushing roller 70. The roller is fabricated by welding end-plates 72 to a shaft 74 and a drum 76. Splines 78 and spikes 80 are secured to the drum 76.

The splines 78 are considerably shorter than the splines 18 in the earlier drawings. Also, the drum 76 is of a larger diameter than the shaft 12. As a result, the items to be crushed can be expected to tend to bottom against the drum much more than they would tend to bottom against the shaft 12.

It might be expected that items that had passed through the roller 70 would be more crushed, and more evenly crushed, and in fact there is some small gain in degree of crushing with FIG. 7. However, in most cases, the earlier arrangement, using the long splines, is preferred, because of the increased "grab-ability" that arises from, and is a consequence of, the long splines. Preferably, the items should not "bottom" against the cylindrical surface between the splines.

In fact, insofar as a trade-off has to be made, it is usually preferable to sacrifice a little crushing in order to ensure that substantially any and all items entering the hopper are quickly grabbed into the pinch-throat, and forced between the roller and the crush plate.

FIG. 7*a* is a diagram illustrating the spacing of the splines and spikes 78 and 80. It has been found that the items to be crushed are grabbed and forced into the pinch-throat more efficiently if the extremity of the forward movement of the beak of the crammer is timed to occur at a gap between the passing splines on the roller. In fact, it was found that splines should be absent from some orientations of the roller (as may be understood from FIG. 7*a*) in order to permit the beak to force an item between the splines, thus enabling the item to be grabbed. The timing of the movement of the crammer in relation to the spacing of the splines is thus seen to be of importance in maximising the efficiency of grabbing.

It may be noted that it will be most obstructive to the operation of the garbage collection truck if the operator has to stop to clear an item that refuses to be grabbed. The system preferably should be such that there is not a single instance of an item remaining ungrabbed during the whole collection shift. The emphasis is that no-exceptions grabability is more important than absolute crushing power.

Of course, some items will be too large to be grabbed. There is a requirement on householders not to place items above a certain size in the re-cycling boxes; just as there is a requirement not to place un-crushable items, such as telephone directories, in the boxes.

Some items are unsuitable for passing through the crusher apparatus, being items that have been wrongfully categorised as recycle-able by the householder. It depends on the particular case as to what should be done about such items—whether it is better to let the items pass through the crusher and be manually separated later, or to allow the item to stall the crusher, whereby the item is cleared immediately but at the expense of stopping and interrupting the collection process.

In fact, it has been found that a telephone directory will sometimes pass through the crusher without stalling the drive. Some items that are placed occasionally in garbage categorised for recycling will inevitably stall the drive: items such as castiron saucepans, planks of wood, hair-dryers, and the like. The apparatus copes with glass bottles in that the glass is simply broken. Aerosol cans are punctured and crushed, even though the puncturing of an aerosol might sometimes be explosive. Cans and bottles with liquid still inside, such as cans of paint, are crushed as if the liquid were not present: the liquid of course then spills and flows into the bottom of the apparatus.

Even large items can be grabbed if enough purchase can be gained to force the item past the condition shown in FIG. 1. Some items, though nominally too large, are soft enough that even though the item may be of a large diameter the item can be distorted by the action of the crammer to what appears to the crusher machine to be a small enough diameter that the item can be seized.

FIG. 8 shows a modification that may be made to the crammer in order to enable grabbing to be performed with even more efficiency. The spikes 83 set into the upper surface of the crammer 85 provide enough extra purchase on the large, and especially soft, items.

FIG. 9 shows a crusher unit 87 installed in a garbage collection truck. The unit 87 is placed low enough on the side of the truck that the operator can easily tip the items to be crushed into the hopper 89. After being crushed, the items emerge into the chute 90, through which the items travel upwards into the receptacle 92. It may be noted that no elevator or conveyor belt or the like is required in order to force the crushed items into the receptacle 92: the action of the crusher unit in forcing the items through and out is sufficient to force the items upwards into the receptacle.

Thus, the entry hopper 89 of the crusher unit 87 may be positioned lower than the receptacle 92, Even when the receptacle is almost full, the operator still can tip the items into the hopper at the low level. The chassis of the truck is shown diagrammatically at 94: as will be understood, the crusher unit may be positioned lower than the top of the chassis.

Where the crusher unit is installed such that the unit acts to "pump" the crushed items up into a receptacle, it will be preferred to take steps to prevent the just-crushed items from passing around the crusher roller again. The strippers 96 are shaped so as to within the chute 90 to some extent, so that an item, once it has become detached from the roller, will hardly ever be drawn back into the roller due to random bouncing motion.

It is a relatively easy matter for the operator to tip items into the hopper, provided the hopper is not above waist height. There should preferably be no requirement that the operator should have to climb steps or otherwise raise the items above waist-height (ie waist-height when he is standing on the ground beside the truck) since that would greatly reduce the efficiency with which he can handle large quantities of items shift after shift. The design of the apparatus as described allows the hopper to be placed, on the truck, at or below waist-height. It may be noted that some conventional designs of truck-installed garbage processing equipment do require the operator to climb steps, as the shift progresses, to place garbage on top of a progressively rising pile thereof.

In a real installation, safety precautions must of course be taken to ensure the operator cannot be injured by the crusher.

It is a consequence of the manner in which a garbage collection truck is operated that a time period of at least several seconds occurs between the occasions when the operator tips successive loads of recycle-able items into the hopper, as he moves from collection point to collection point. In the normal manner of use, there is no requirement that the crusher should be able to process a large quantity of items received all at once, and it is no disadvantage if the items in the hopper take a few seconds to clear, since those few seconds will inevitably be available.

The unit as described is especially suitable for use actually on the garbage collection truck, since the operation of the unit fits the timing and manner of operation of the truck so well. The unit may be driven by means of a hydraulic pump, which is readily added as a belt-driven accessory to the kind of engine that is normally fitted to a garbage truck.

We claim:

1. Crushing apparatus, which is suitable for crushing metal and plastic containers in domestic garbage, wherein:

the apparatus includes a crush rotor, which is mounted in bearings for rotation with respect to a frame of the apparatus;

the apparatus includes a cooperating crush plate;

the crush rotor and the crush plate are so arranged as to define a pinch-throat;

the pinch-throat is a progressively narrowing space between the crush rotor and the crush plate, commencing at an open mouth of the pinch-throat, and the pinch-throat width is the distance between a point on the overall diameter of the crush rotor and the corresponding closest point thereto on the crush plate;

the arrangement of the apparatus is such that items entering the open mouth and then passing through the pinch-throat are crushed between the crush plate and the crush rotor;

at the mouth of the pinch-throat the pinch-throat tapers gently, in that a tangent to the overall diameter of the crush rotor at the mouth, and a tangent to the crush plate at the corresponding point, subtend a small angle;

the apparatus includes a means for receiving items to be crushed, which is so arranged in the apparatus that items therein fall under gravity onto the rotor, and the direction of rotation of the rotor is such as to carry the items towards the open mouth of the pinch-throat;

the apparatus includes a crammer, which includes a beak;

the apparatus includes a crammer driver, which is effective to reciprocate the crammer in such a manner that the beak of the crammer moves cyclically towards and away from a point on the crush rotor, being a point located between the hopper and the pinch-throat.

2. Apparatus of claim 1, wherein the said angle is small enough that an item, upon entering the pinch-throat, experiences only a negligible resistance to continuing into the pinch-throat.

3. Apparatus of claim 1, wherein the said angle is no more than 20 degrees.

4. Apparatus of claim 1, wherein the crush plate is curved, the curvature of the crush plate being concave with respect to the crush rotor.

5. Apparatus of claim 1, wherein the crammer reciprocates between an open position with respect to the crush rotor, and a cramming position.

6. Apparatus of claim 5, wherein, in the cramming position, the beak of the crammer is spaced a distance of 4 cm from the overall diameter of the crush rotor.

7. Apparatus of claim 6, wherein, in the open position, the crammer is spaced far enough from the crush rotor as to admit a cylinder of diameter 18 cm therebetween.

8. Apparatus of claim 1, wherein the crammer is mounted on a pivotal shaft disposed parallel to the axis of the crush rotor, whereby the said reciprocating movement of the beak is arcuate movement about the pivotal shaft.

9. Apparatus of claim 1, wherein the overall diameter of the rotor is 20 cm.

10. Apparatus of claim 1, wherein the pinch-throat width at the mouth is 10 cm.

11. Apparatus of claim 1, wherein the apparatus includes a mat of resilient high-friction material, and the mat is located on the surface of the crush plate that faces the crush rotor, adjacent to the mouth.

12. Apparatus of claim 11, wherein the mat is present only adjacent to the mouth, the remainder of the surface of the crush plate being free of the said resilient high-friction material.

13. Apparatus of claim 1, wherein the crush plate is mounted on a pivot, and the apparatus includes a heavy spring, which is arranged to urge the crush plate about the pivot towards the crush rotor.

14. Apparatus of claim 1, wherein:

the crush plate is curved, the curvature of the crush plate being concave with respect to the crush rotor;

an exit point is the point on the crush plate where the width of the progressively narrowing pinch-throat is at its narrowest;

with respect to the centre of curvature of the crush plate, the angle between the exit point and the pivot point is no more than 120 degrees.

15. Apparatus of claim 1, wherein:

the crush rotor includes blades or splines, being splines which protrude radially from a central shaft of the rotor;

the splines are so arranged on the rotor as to define radially open spaces between adjacent splines.

16. Apparatus of claim 15, wherein some of the splines are equipped with radially-protruding pointed spikes.

17. Apparatus of claim 15, wherein:

the apparatus includes a stripper;

the splines are formed with at least one interruption or gap;

the stripper is fixed to the frame of the apparatus, and extends into the gap, and is arranged in such a manner as to strip off an item snagged to the splines and extending into the gap.

18. Apparatus of claim 15, wherein the said open spaces are deep, in that the radial length of adjacent splines, being the radial distance from the central shaft to the tip of the spline, is more than the circumferential distance apart of the tips of the adjacent splines.

19. Apparatus of claim 1, wherein the means for receiving items is a hopper, and the hopper is large enough that a batch of items may be placed in the hopper, and may be contained therein while gradually all the items feed through into the mouth of the pinch-throat.

20. Apparatus of claim 1, wherein the crammer is fitted with integral sharp spikes, which extend towards the rotor, and which are positioned above the beak of the crammer.

21. Apparatus of claim 1, in combination with a garbage collection truck, wherein:

the truck is of the type which is adapted for travelling to many garbage pick-up points successively with a time period of at least several seconds between pick-up points, and to pick up an amount of garbage at each pick-up point;

and the hopper is of a size to receive and contain the said amount of garbage.

22. Combination of claim 21, wherein:

the hopper is mounted directly above the crush rotor and the crush plate, whereby items present in the hopper tend to fall under gravity into the open mouth of the pinch-throat;

the apparatus is fixedly mounted on the truck is such a position that the hopper is, and remains, around waist-height to an operator standing beside the truck.

23. Combination of claim 22, wherein:

the truck includes a receptacle for receiving and containing the crushed items emerging from the crushing apparatus;

the receptacle is such that the receptacle includes a storage volume for the crushed items which is located at a height or vertical position in the truck that is higher than the hopper;

the apparatus includes an outlet, through which the crushed items emerge;

the combination includes a chute, in which the crushed items emerging through the outlet are received;

the chute is effective to constrain and guide the items for movement into the receptacle, the chute being so arranged that a component of the movement of the items in the chute is upwards;

and the combination is so arranged that the force of emergence of this items from the outlet into the chute is sufficient to drive items already present in the chute up the chute and into the receptacle.

24. Combination of claim 21 wherein:

the combination includes a hydraulic pump driven as an accessory from the truck engine;

and the crush roller is rotated by hydraulic power from the pump.

* * * * *